United States Patent [19]

Watt

[11] Patent Number: 4,981,085

[45] Date of Patent: Jan. 1, 1991

[54] TABLE LIFT MECHANISM

[75] Inventor: Richard L. Watt, Jamestown, N.Y.

[73] Assignee: Weber-Knapp Company, Jamestown, N.Y.

[21] Appl. No.: 390,538

[22] Filed: Aug. 7, 1989

[51] Int. Cl.[5] ..... A47B 9/00

[52] U.S. Cl. ..... 108/147; 108/146; 248/162.1

[58] Field of Search ..... 108/146, 147, 144; 248/162.1, 280.1, 292.1, 297.1, 188.5; 74/89.15

[56] References Cited

U.S. PATENT DOCUMENTS

| | | | |
|---|---|---|---|
| 537,081 | 4/1895 | Starkey . | |
| 699,939 | 5/1902 | Woodruff . | |
| 2,713,520 | 7/1955 | Greene | 108/147 X |
| 3,347,511 | 10/1967 | Myers | 108/147 X |
| 4,111,389 | 9/1978 | Gundlach et al. | 248/162.1 |
| 4,360,180 | 11/1982 | Bauneau | 108/146 X |
| 4,381,095 | 8/1983 | Kritske | 108/144 X |
| 4,559,879 | 12/1985 | Hausser | 108/146 X |
| 4,590,865 | 5/1986 | Rutsche et al. | 108/1 |
| 4,601,246 | 7/1916 | Damico | 108/146 X |
| 4,611,777 | 9/1986 | Ireland et al. | 248/162.1 X |
| 4,619,208 | 10/1986 | Kurrasch | 108/147 X |
| 4,627,591 | 12/1986 | Heckmann | 248/411 |
| 4,667,605 | 5/1987 | Bastian | 108/144 |
| 4,747,353 | 5/1988 | Watt | 108/146 |

FOREIGN PATENT DOCUMENTS

| | | |
|---|---|---|
| 515132 | 11/1957 | Belgium . |
| 3303193A1 | 8/1984 | Fed. Rep. of Germany . |

*Primary Examiner*—Jose V. Chen

*Attorney, Agent, or Firm*—Bean, Kauffman & Spencer

[57] ABSTRACT

Furniture having a top or the like supported for vertical movement by telescopic leg supports is provided with a counterbalance mechanism for exerting a relative uniform counterbalance force on the top throughout its range of vertical movement, a latch mechanism for releasably latching the top in selected vertical positions, and an adjustable roller guide mechanism for coupling telescopic elements of the leg supports.

11 Claims, 5 Drawing Sheets

Fig. 3.
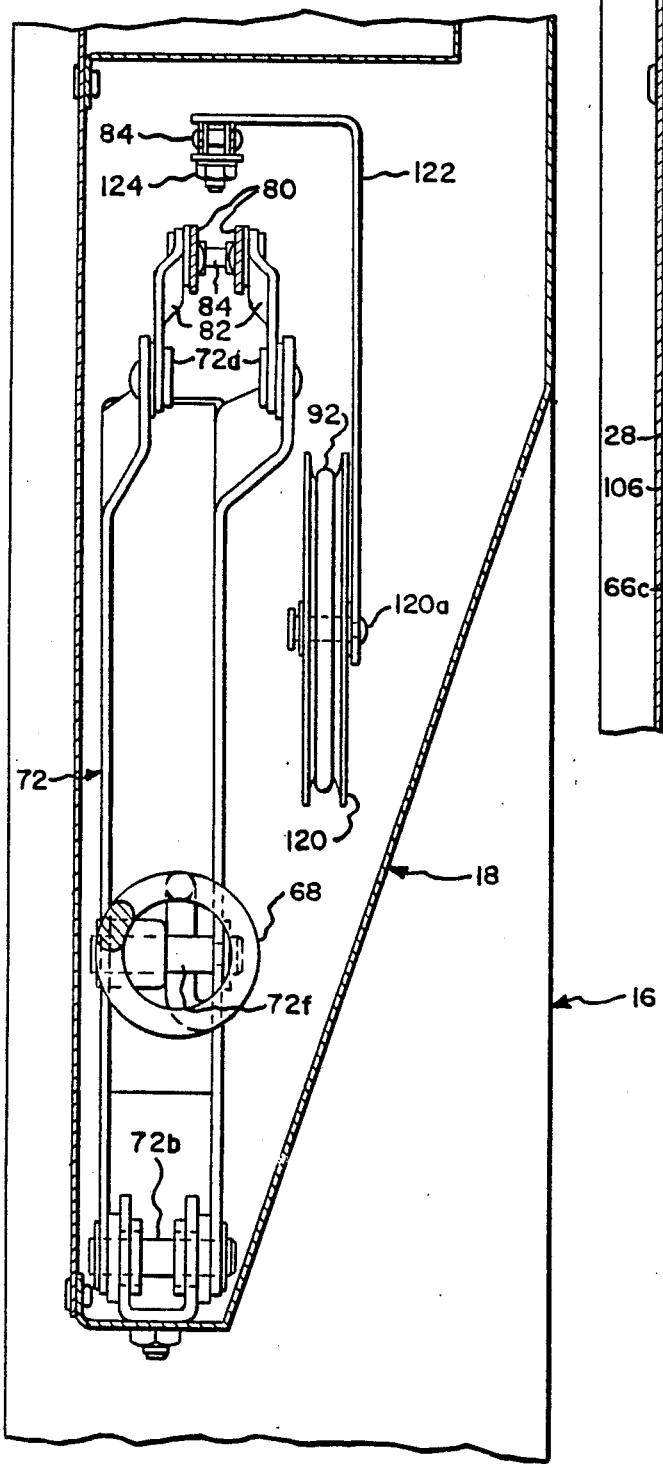
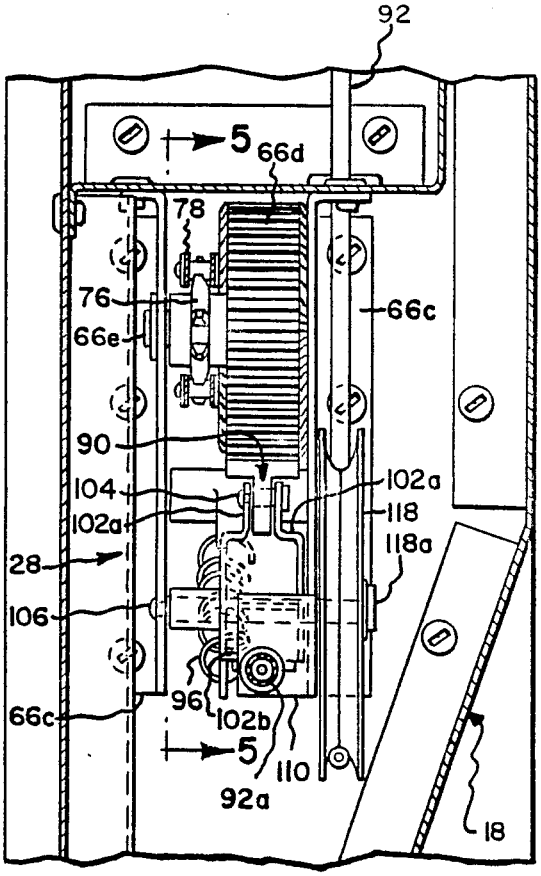
Fig. 4.

TABLE LIFT MECHANISM

BACKGROUND OF THE INVENTION

Furniture, such as drafting tables or the like, having vertically adjustable tops supported by a pair of telescopic leg supports incorporating rack and pinion type drives, is well-known as evidenced for example by U.S. Pat. Nos. 537,091; 4,627,591; 4,747,353 and West German Published application No. DE 3303193A1. Further, it is generally known to provide vertically adjustable table tops with counterbalance mechanisms and latching mechanisms for releasably retaining table tops in desired vertical positions, as evidenced by above referenced U.S. Pat. No. 4,627,591 and Belgian Patent No. 515,132.

Prior adjustable height furniture of which I am aware has certain disadvantages including their failure to provide for the application of an essentially uniform counterbalance force throughout the range of vertical adjustment of the furniture. A further difficulty encountered is that of excessive frictional forces present in prior table lift mechanisms.

SUMMARY OF THE INVENTION

The present invention relates to a table, such as a drafting table, having a top intended to be moved vertically between lowered and raised positions, as an incident to use thereof, and more particularly to an improved counterbalance mechanism adapted to apply an essentially uniform counterbalance force to a table top throughout its range of vertical movements in a manner serving to minimize frictional forces required to be overcome during such movements.

The present counterbalance mechanism includes a drive means for effecting vertical movement of a table top, a counterbalance spring for exerting a variable spring force and coupling means for coupling the spring to the drive means for establishing an essentially uniform counterbalance force applied to the table top. The coupling means includes a lever supported adjacent one end thereof for pivotal movement between first and second positions corresponding to lowered and raised positions of the table top and a flexible drive for coupling the drive means to an opposite end of the lever, wherein the spring is connected to the lever intermediate the ends thereof. In a preferred construction, the drive means includes racks carried by the telescopic leg supports for the table top and gears arranged to mesh with the racks and be driven by the flexible drive.

The present invention also includes an adjustable roller guide mechanism for coupling telescopic elements of the leg supports of the table top and a latch mechanism for releasably retaining the table top in a desired vertical position.

BRIEF DESCRIPTION OF THE DRAWINGS

The nature and mode of operation of the present invention will now be more fully described in the following detailed description taken with the accompanying drawings wherein:

FIG. 3 is an enlarged sectional view taken generally along line 3—3 in FIG. 2;

FIG. 4 is an enlarged sectional view taken generally along line 4—4 in FIG. 2;

DETAILED DESCRIPTION

Figure 1:
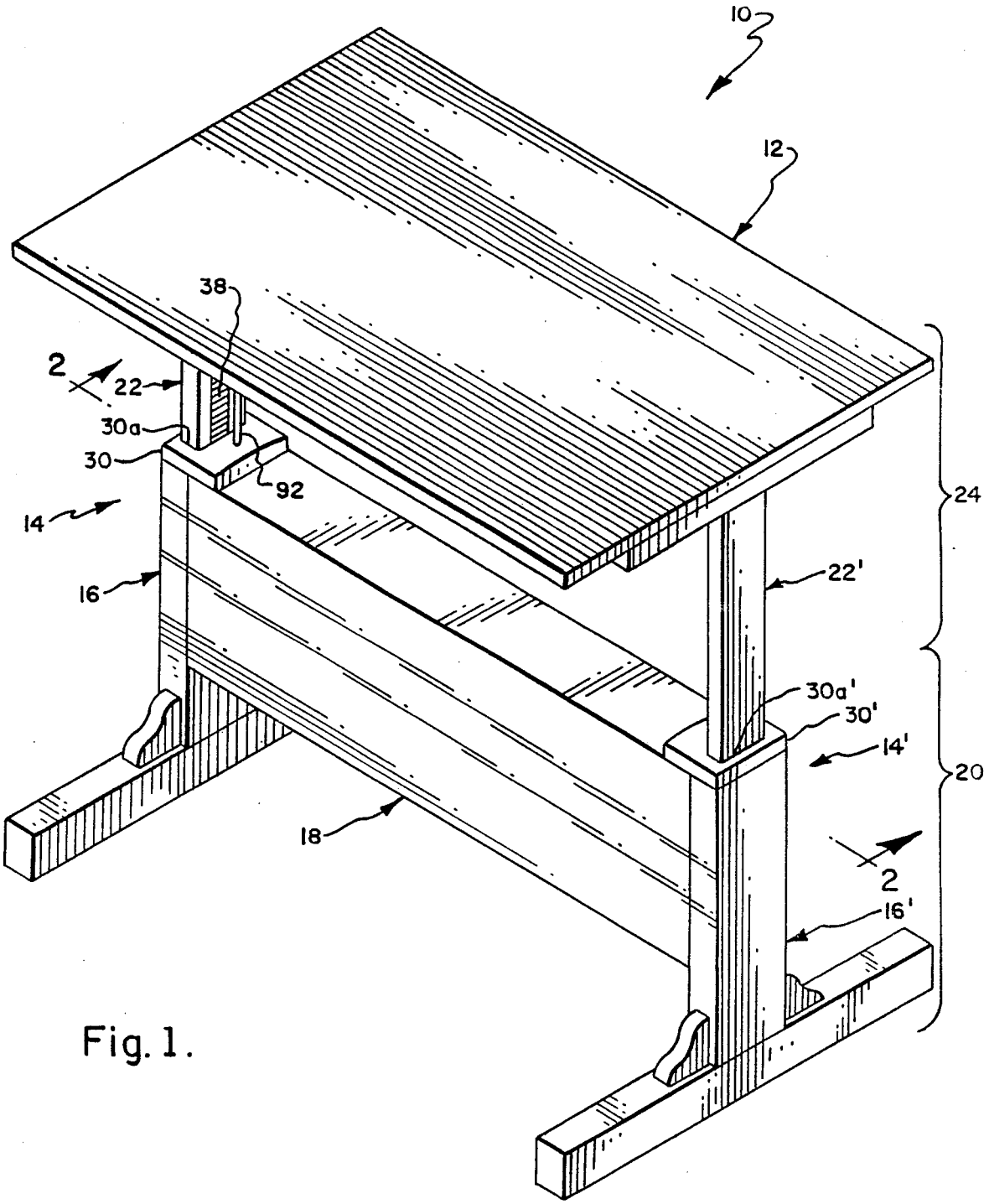
FIG. 1 is a perspective view of a piece of furniture formed in accordance with the present invention.

Reference is first made to FIG. 1, wherein a piece of furniture, such as drafting table 10, is shown as generally including a top portion 12 and a pair of lengthwise extensible leg supports 14 and 14, which are of mirror image construction and have lower, stationary parts 16 and 16' transversely interconnected by a horizontally extending, hollow beam 18 to define a rigid, stationary support assembly 20 and upper, movable parts 22 and 22', which are supported for vertically directed reciprocating movement by the stationary parts and have their upper ends suitably affixed to the top portion to define a rigid, movable top assembly 24. Beam 18 is sized to provide a privacy screen and enclose a counterbalance mechanism 26 and a latch mechanism 28 to be hereinafter described with primary reference to FIGS. 2–5.

To facilitate description of assemblies 20 and 24, only stationary part 16 and movable part 22 will be specifically described with particular reference to FIGS. 1, 2 and 6–8 with primed numerals being employed to designate like elements of parts 16' and 22'. Stationary part 16 is in the form of a generally hollow or tubular extrusion having an upper end fitted with a plastic guide cap **30*a* having a guide opening 30 sized and shaped to slidably receive its associated movable part 22; a pair of parallel, facing guide tracks 32 and 34, which depend within the stationary part from adjacent the guide opening; and an opening 36 disposed in alignment with one end of beam 18. Movable part 22 is also preferably in the form of a hollow or tubular extrusion provided with a lengthwise extending T-shaped mounting recess 22*a* for receiving a vertically extending gear rack 38, which forms part of mechanism 26 and is disposed for alignment with opening 36 of its associated stationary part 16; and a roller assembly or guide means 40 disposed adjacent its lower end. Rack 38 is fixed against movement lengthwise within recess 22*a*** by screw devices, not shown.

Figure 6:
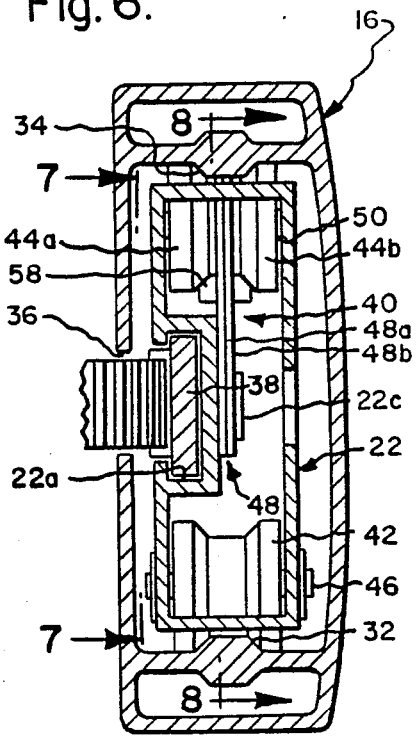
FIG. 6 is an sectional view taken generally along line 6—6 in FIG. 2.
Figure 7:
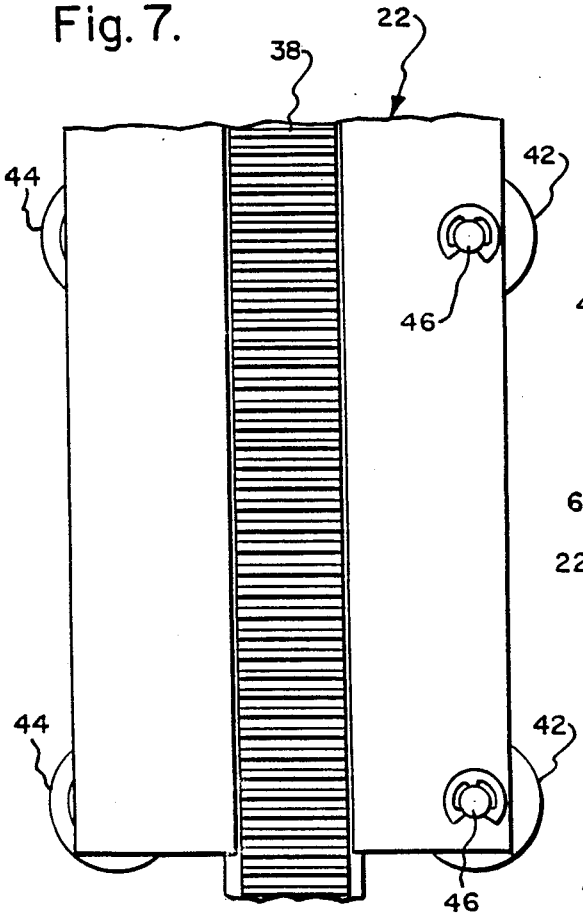
FIG. 7 is an enlarged sectional view taken generally along line 7—7 in FIG. 6.
Figure 8:
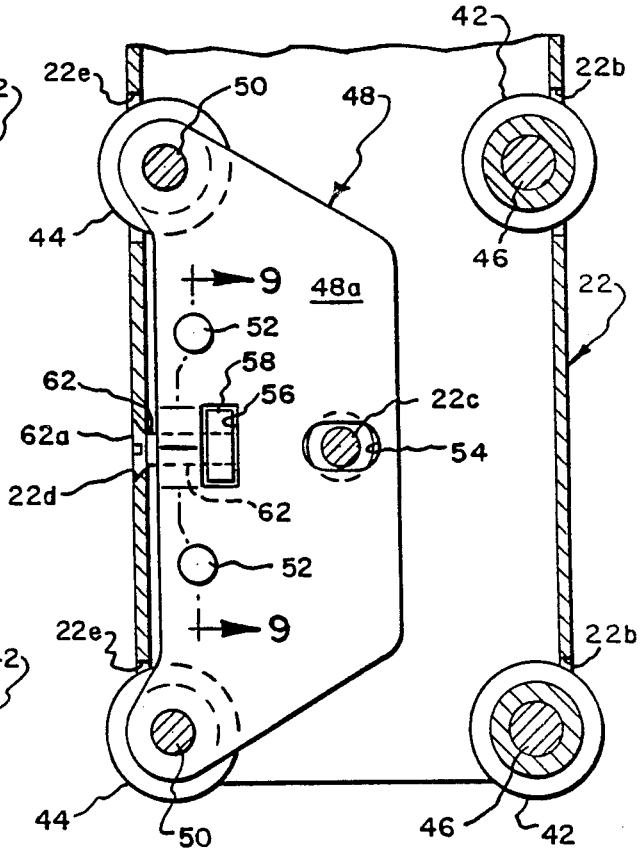
FIG. 8 is an enlarged sectional view taken generally along line 8—8 FIG 6.

Guide assembly 40 is best shown in FIGS. 6–9 as including first and second pairs of upper and lower guide rollers 42 and 44 arranged for rolling engagement with tracks 32 and 34, respectively. First roller pair 42 are supported for rotation about a first pair of parallel axes positionally fixed relative to movable part 22 by a pair of upper and lower parallel axles 46 and 46 spaced apart lengthwise of movable part 22 and arranged to project outwardly of the movable part through a first pair of clearance openings **22*b* and 22*b*. Second roller pair 44 are each defined by a pair of roller halves 44*a* and 44*b* best shown in FIG. 6, which are arranged on opposite sides of an adjustment or mounting plate 48 and supported thereon for rotation about a second pair of parallel axes positionally fixed relative to the adjustment plate by parallel common axles 50 and 50 best shown in FIG. 8. Adjustment plate 48 is in turn comprised of a pair of plates 48***a* and 48*b*, which are of mirror image construction and fixed face to face by rivets 52 and 52. Plates 48*a* and 48*b* are apertured to define a first through opening slot 54 sized to loosely receive a mounting pin 22*c* projecting inwardly of the lower end of movable part 22 and second through opening slot 56 sized to loosely receive an adjustment nut 58, and are shaped such that the plates cooperate to define a clearance opening 60, which is lengthwise bisected by a plane defined by the abutting surfaces of the plates and communicates with second slot 56. Assembly 40 also includes an adjustment screw 62 having a slotted head portion 62*a* rotatably seated within a conforming aperture 22*d* formed in the lower end of movable part 22 in essential transverse alignment with mounting pin 22*c* and a threaded shank portion 62*b* loosely received within clearance opening 60 and threadably inserted within nut 58. Access to head portion 62*a* for adjustment purposes is afforded by an access opening, not shown, formed in the lower end of stationary part 16. With adjustment plate 48 mounted on pin 22*c* in the manner shown in FIG. 8, rollers 44 are arranged to freely project outwardly through a second pair of clearance openings 22*e* and 22*e* provided adjacent the lower end of movable part 22 and the adjustable plate is free to rotate or rock and slide back and forth within the confines of the movable part. Adjustment of screw 62 serves to move adjustment plate 48 in order to place rollers 42 and 44 in rolling engagement with tracks 32 and 34, respectively; the adjustment plate rotating or rocking and sliding relative to pin 22*c* and nut 58 tilting within slot 56, as required to ensure that all four rollers are in engagement with the tracks while maintaining the second pair of rotational axes of roller pair 44 substantially parallel to the first pair of rotational axes of roller pair 42, as shown in FIGS. 6 and 8.

Figure 2:
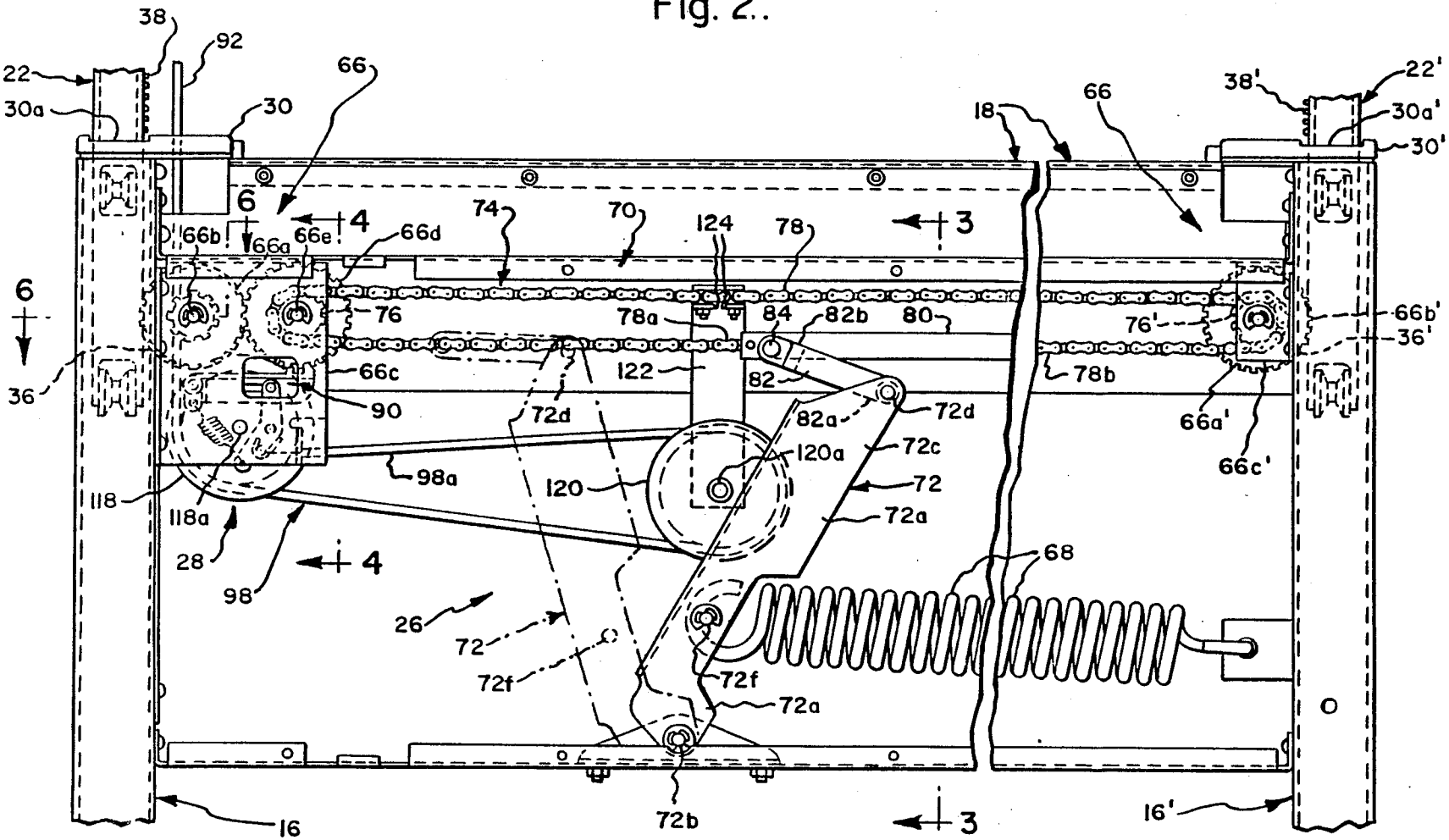
FIG. 2 is a sectional view taken generally along line 2—2 in FIG. 1.

Counterbalance mechanism 26 is shown in FIG. 2 as generally comprising drive means 66; a counterbalance spring preferably in the form of a coil type tension spring 68; and coupling means 70 for coupling the counterbalance spring to the drive means in a manner allowing the application to top assembly 24 of a relatively uniform counterbalance force throughout the full range of travel of the top assembly between a table top raised or upper position shown generally in FIGS. 1 and 2 and a table top lowered position, not shown. Various means may be employed to define the limiting positions of table top 12. However, as by way of example, engagement of uppermost rollers of roller pairs 42 and 44 with the lower surface of guide cap 30 may serve to define the raised position and engagement of the lower end of movable parts 22 and 22' with suitable stops, not shown, may serve to define the lowered position.

Drive means 66 consists of previously mentioned racks 38 and 38' and a pair of drive gears 66*a* and 66*a'*, which are rotatably supported on stationary parts 16 and 16' by bearing shafts 66*b* and 66*b'* carried by stationary part mounted brackets 66*c* and 66*c'* and arranged to project inwardly of the stationary parts through openings 36 and 36' for driving engagement with such racks.

Coupling means 70 generally includes a generally U-shaped lever 72 having a first or lower end 72*a* supported on beam 18 by bearing shaft 72*b* for pivotal movement about a horizontally disposed axis, a second or upper end 72*c* carrying a pin connection 72*d* and an intermediate portion 72*e* carrying a second pin connection 72*f*; and a flexible drive 74 for coupling the lever via pin connection 72*d* to gears 66*a* and 66*a'*. Flexible drive 74 includes first and second sprockets 76 and 76'; a flexible drive chain 78, which is trained about the first and second sprockets and has first and second ends 78*a* and 78*b*; an adjustable turnbuckle coupling device 80 for connecting the first and second ends of the chain; and coupling link(s) 82 having a first end 82*a* pivotally connected to lever 72 via pin connection 72*d* and a second end 82*b* pivotally connected to the turnbuckle coupling device via a pin connection 84. Coupling device 80 is employed to apply sufficient tension to chain ends 78*a* and 78*b*, as will ensure that a counterbalance force to be described is essentially equally applied by gears 66*a* and 66*a'* to racks 38 and 38'. The pivot axes defined by bearing shaft 72*b* and pin connections 72*d* and 84 are essentially parallel.

First sprocket 76 is drivingly coupled to drive gear 66*a*, as by being formed integrally with a third drive gear 66*d*, which is rotatably supported on stationary part mounted bracket 66*c* by bearing shaft 66*e* and arranged to mesh with drive gear 66*a*, and second sprocket 76' is drivingly coupled to drive gear 66*a'*, as by being formed integrally therewith.

By again viewing FIG. 2, it will be understood that counterbalance spring 68 has its opposite ends fixed to stationary part 16' and to lever 72 via pin connection 72*f* and serves to exert a bias tending to pivot the lever from a first position shown in broken line towards a second position shown in full line, which positions correspond to the lowered and raised positions of top assembly 24, respectively. As lever 72 pivots between its positions, pin connection 72*d* first moves vertically towards, then overcenter and finally downwardly away from the lower run of chain 78, as defined by ends 78*a*, 78*b* and coupling device 80, and coupling link(s) 82 undergoes pivotal movements about pin connections 72*d* and 84, so as to prevent vertical movements of pin connection 72*d* from imparting transverse or vertical flexures to the lower run of the chain. In the construction illustrated in FIG. 2, the moment arm through which tension spring 68 acts, during pivotal movements of lever 72, progressively varies so as to produce an essentially uniform counterbalance force acting through chain 78 to apply an essentially uniform counterbalance force to top assembly 24 and thus table top portion 12.

Preferably, the counterbalance force is selected such that it will cooperate with frictional forces inherent in the system, e.g. frictional forces including those encountered due to telescopic movements of parts 16, 16' and 22, 22' and engagement of drive gears 66*a*, 66*a'* with racks 38, 38', to define a counterbalance envelope preventing vertical displacements of top assembly 24 in the absence of the application thereto by a user of an additional raising or lowering force. However, if desired, the counterbalance envelope may be tailored to permit top assembly 24 to automatically move into its raised position or lowered position, whenever latch mechanism 28 is intentionally released by a user.

Figure 5:
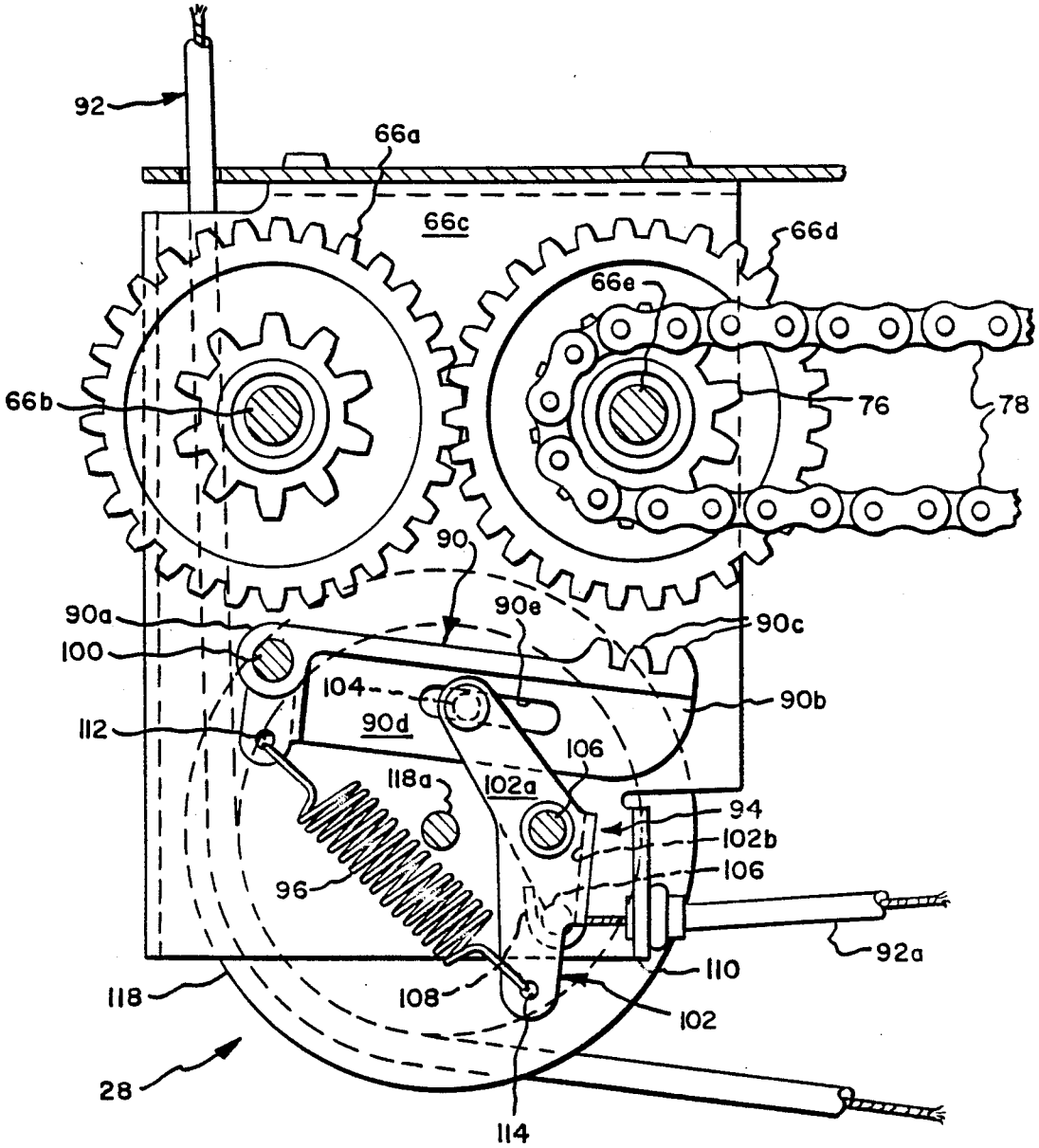
FIG. 5 is an enlarged sectional view taken generally along line 5—5 in FIG. 4 but showing the latch arm in release position.
Figure 9:
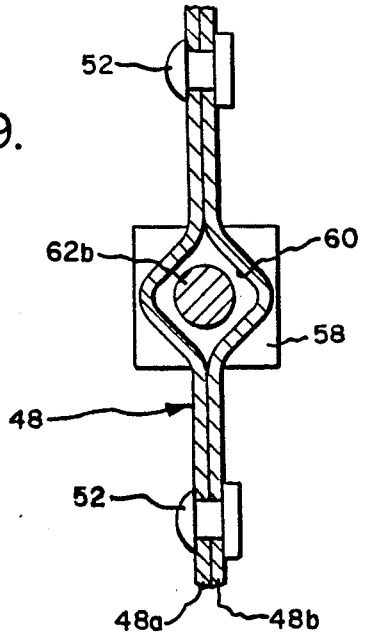
FIG. 9 is an enlarged sectional view taken generally along line 9—9 in FIG. 8.

Latch mechanism 28 is shown in FIGS. 2, 4 and 5 as generally including a latch arm 90; a user operated pull cable 92; coupling means 94 for coupling a lower end 92*a* of cable 92 to latch arm 90; a tension spring 96; and a pulley assembly 98 for guiding cable lower end 92*a* to coupling means 94. Latch arm 90 has a first end 90*a* pivotally supported on brackets 66*c*, 66*c* by a bearing shaft 100 for movement between latching and release positions of the latch arm shown generally in FIGS. 2 and 5, respectively; a second end 90*b* formed with teeth 90*c* sized to latchingly engage with third drive gear 66*d* when the latch arm is in its latching position; and an intermediate portion 90*d* formed with a lengthwise extending, through slot opening 90*e*.

In accordance with a preferred form of the invention, coupling means 94 is defined by a generally U-shaped bracket 102 having parallel arms 102*a*, 102*a* and a connecting plate 102*b*; and a guide/connecting pin 104, which is slidably/rotatably received within slot opening 90*e* of latch arm 90 and has its opposite ends carried by arms 102*a*, 102*a*. Bracket 102 is pivotally supported by a bearing shaft 106, which extends through arms 102*a*, 102*a* and has its opposite ends supported by brackets 66*c*, 66*c* as best shown in FIG. 4; and is connected to cable lower end 92*a* by a cable free end fitting 106 received within a fork-shaped receiver 108 defined by connecting plate 102*b*. The free end of cable lower end 92*a* may be located adjacent receiver 108 by a guide flange 110 formed integrally with the right hand one of mounting brackets 66*c*, as viewed in FIG. 5. Bracket 102 is also connected to latch arm 90 by spring 96 whose opposite ends are received within apertures 112 and 114 formed in latch arm first end 90*a* and one of bracket arms 102*a*. Thus, spring 96 establishes a bias tending to pivot latch arm 90 and bracket 102 in counterclockwise and clockwise directions, respectively, as viewed in FIG. 5, whereby to normally maintain the latch arm in its latching position shown in FIG. 2.

Pulley assembly 98 includes a first pulley 118, which is rotatably supported by a bearing shaft 118*a* extending through brackets 66*c*, 66*c*; and a second pulley 120, which is rotatably supported by a bearing shaft 120*a* carried adjacent the lower end of a hanger bracker 122. Hanger bracket 122 has its upper end clamped to the upper run of chain 78 by bolt devices 124, as best shown in FIGS. 2 and 3. As will be apparent from the drawings, cable 92 extends vertically downwardly from top portion 12 along the inner surface of movable part 22 and into beam, wherein pulleys 118 and 120 cooperate to first turn the cable through an angle less than 90° for movement away from the movable part and then through an angle in excess of 180° for return movement towards the movable part and for connection to bracket 102. The upper end of cable 92 is connected to a suitable operator, not shown, which is fixed to the lower surface of top portion 12 and operable in response to the application of pressure by a user of furniture 10 to pull cable 92 for purposes of effecting movement of latch arm 90 into its releasing position shown in FIG. 5 against the return bias of spring 96. A typical commercially available operator would be in the form of a paddle or operating lever hinge connected to top portion 12.

Pulley assembly 98 serves as an accumulator for storing cable 92 within the confines of beam 18, wherein movement of pulley 120 towards pulley 118 allows a sufficient length of the cable to be withdrawn from the beam, as required to accommodate for raising of top portion 12 into its uppermost adjusted position, and wherein movement of pulley 120 away from pulley 118 increases the length of the cable stored by the pulley assembly within the beam incident to lowering of the top portion. In the absence of the pulley assembly, kinking of the cable intermediate top portion 12 and beam 18 and/or within the confines of beam 18 would likely occur whenever the top portion is moved into its lowermost position. The rate of movement of the table top is about twice the rate of movement of the chain.

In operation, a user may adjust the height of top portion 12 by first manipulating an appropriate operator for purposes of exerting a pulling force on cable 92, which in turn effects movement of latch arm 90 from its latching position into its release position against the bias of spring 96, and then applying force to the top portion sufficient to move same into a desired adjusted position. When the desired adjusted position of top portion 12 is reached, the user would simply release the operator in order to allow spring 96 to return latch arm 90 to its latching position, whereupon the top portion is effectively locked or latched against further movement. During the period that latch arm 90 is maintained in its release position, the force generated by spring 68 is effective to counterbalance essentially the entire weight of top assembly 24, such that a user can effect desired vertical adjustment thereof, by exerting only that force necessary to overcome friction present in counterbalance mechanism 26 and the sliding/rolling friction between stationary parts 16 and 16' and movable parts 22 and 22'. An advantage of the present invention is that the structure of counterbalance mechanism 26 and the mode of supporting the movable parts permits frictional forces required to be overcome by a user to be maintained at a very low value.

What is claimed is:

1. A piece of furniture comprising in combination:

a top portion;

a pair of lengthwise adjustable leg supports for supporting said top portion for a range of vertical movement, each of said leg supports includes a stationary part and a movable part; and a counterbalance mechanism for counterbalancing at least part of the weight of said top portion during vertical movement thereof, said mechanism including drive means for effecting lengthwise adjustment of said leg supports, a counterbalance spring for exerting a variable spring force and coupling means for coupling said spring to said drive means for establishing an essentially uniform counterbalance force on said top portion during vertical movement thereof, said coupling means includes a lever supported adjacent one end thereof relative to said stationary part for pivotal movement about an axis between first and second positions corresponding to lowered and raised positions of said top portion, said spring exerting a bias on said lever tending to pivot said lever from said first position into said second position, and a flexible drive for coupling an opposite end of said lever to said drive means, said drive means includes a pair of racks carried one by each of said movable parts and a pair of driven gears carried one by each of said stationary parts and engaged with said racks, said flexible drive includes sprockets drivingly coupled to said driven gears, a drive chain trained about said sprockets, and a coupling link having opposite ends pivotally connected to said opposite end of said lever and to said drive chain, and said opposite end of said lever moves relatively towards and away from said drive chain incident to movement of said lever from said first position towards said second position.

2. A piece of furniture according to claim 1, wherein latch means is provided for releasably locking said top portion in selected positions throughout said range of vertical movement, said latch means includes a latch arm carried by one of said stationary parts and having a top portion latching position and a release position, spring means tending to bias said latch arm into said top portion latching position, a furniture user-actuated push-pull cable for moving said latch arm into said release position against the bias of said spring means, coupling means for coupling said cable to said latch arm, and pulley assembly for guiding said cable from said top portion to said coupling means, said pulley means including a first pulley carried by said one of said stationary parts and disposed adjacent said coupling means and a second pulley carried by said drive chain for movement towards and away from said first pulley incident to upwardly and downwardly directed movements of said top portion.

3. A piece of furniture according to claim 2, wherein said stationary part includes a pair of facing vertically extending guide tracks, said movable part carries two pairs of rollers adjacent a lower end thereof arranged one pair for engagement with each of said guide tracks for guiding said lower end relative to said stationary part, each of said pairs of rollers including an upper roller and a lower roller aligned in the direction of movement of said movable part, one of said pairs of rollers being fixed against displacement relative to said lower end in a direction normal to said direction of said movement of said movable part and another of said pairs of rollers being adjustably fixed to said lower end for movement towards and away from said one of said pairs of rollers in a direction normal to said direction of said movement of said movable part.

4. A piece of furniture according to claim 3, wherein said other of said pairs of rollers is journalled on a common plate means and said plate means is adjustably mounted on said lower end.

5. A piece of furniture according to claim 4, wherein said plate means is adjustably mounted on said lower end by a pin fixed to one of said lower end and said plate means, a slot defined by the other of said lower end and said plate means, said slot movably receiving said pin for movably coupling said plate means to said lower end, a nut loosely carried by said plate means and a threaded fastener having a head portion rotatably engaging with said lower end and a threaded portion threadably engaging with said nut.

6. A piece of furniture comprising in combination:

a top portion;

lengthwise adjustable leg supports for supporting said top portion for a range of vertical movement, each of said leg supports includes a hollow stationary part and a movable part having an upper end connected to said top portion and a lower end telescopically received within said stationary part, said stationary part includes a pair of facing vertically extending guide tracks and guide means disposed adjacent an upper end thereof, two pairs of rollers located adjacent said lower end between said guide tracks and arranged one pair for engagement with each of said guide tracks for guiding said lower end relative to said stationary part, one of said pairs of rollers being rotatable about a first pair of axes fixed against displacement relative to said lower end, plate means for mounting an other of said pairs of rollers for rotation about a second pair of axes, and means to adjustably mount said plate means on said lower end for rotational and sliding movement relative thereto for moving said second pair of axes towards and away from said first pair of axes in a direction normal to the direction of said movement of said movable part while maintaining the axes of said one and said other pairs of rollers essentially parallel, as required to place all rollers of said two pairs of rollers in engagement with said guide tracks, said guide means slidably supports said movable part above said lower end; and a counterbalance mechanism for counterbalancing at least part of the weight of said top portion during vertical movement thereof, said mechanism including drive means for effecting lengthwise adjustment of said leg supports, a counterbalance spring for exerting a variable spring force and coupling means for coupling said spring to said drive means for establishing an essentially uniform counterbalance force on said top portion during vertical movement thereof.

7. A piece of furniture according to claim 6, wherein said means to adjustably mount said plate means includes a pin fixed to one of said lower end and said plate means, a slot defined by the other of said lower end and said plate means, said slot movably receiving said pin for movably coupling said plate means to said lower end for relative rotational and sliding movements, a nut loosely carried by said plate means and a threaded fastner having a head portion rotatably engaging with said lower end and a threaded portion threadably engaging with said nut, and rotation of said threaded fastner effects relative movement of said pin within said slot.

8. A piece of furniture comprising in combination:

a top portion;

lengthwise adjustable leg supports for supporting said top portion for a range of vertical movement, said leg supports include a pair of hollow stationary parts and a pair of movable parts having upper ends connected to said top portion and lower ends telescopically received one within each of said stationary parts; and a counterbalance mechanism of counterbalancing at least part of the weight of said top portion during vertical movement thereof, said mechanism including drive means for effecting lengthwise adjustment of said leg supports, a counterbalance spring for exerting a variable spring force and coupling means for coupling said spring to said drive means for establishing an essentially uniform counterbalance force on said top portion during vertical movement thereof, said drive means includes a pair of vertically extending racks carried one on each of said movable parts and a pair of gears journalled one on each of said stationary parts for engagement with said racks, said coupling means includes a third gear arranged to mesh with one of said pair of gears, a pair of sprockets fixed for rotation one with each of said third gear and the other of said pair of gears, a lever supported adjacent one end thereof relative to said stationary parts for pivotal movement about an axis and having a second end, a chain trained about said sprockets and a coupling link pivotally coupled adjacent opposite ends thereof to said chain and said second end of said lever, said counterbalance spring is connected to said lever intermediate said ends thereof and provides a bias tending to pivot said lever from a first position into a second position corresponding to lowered and raised positions of said top portion, respectively, and said second end of said lever moves successively towards and away from said chain incident to movement of said lever from said first position into said second position thereof.

9. A piece of furniture according to claim 11, wherein latch means is provided for releasably locking said top portion in selected positions throughout said range of vertical movement, said latch means includes a latch arm carried by one of said stationary parts and having a top portion latching position and a release position, spring means connected to said latch arm tending to bias said latch arm into said top portion latching position, a furniture user-actuated pull cable for moving said latch arm into said release position against the bias of said spring means, coupling means for coupling said cable to said latch arm, and pulley means for guiding said cable from said top portion to said coupling means, said pulley means including a first pulley carried by said one of said stationary parts and disposed adjacent said coupling means and a second pulley carried by said drive chain for movement towards and away from said first pulley incident to upwardly and downwardly directed movements of said top portion, and said latch arm latchingly engages with one of said pair of gears and said third gear.

10. A vertically extensible support comprising in combination:

a vertically upstanding, hollow stationary part having an upper end formed with a guide opening and a pair of facing guide tracks depending vertically from adjacent said guide opening; a movable part arranged within said stationary part and having an upper end portion slidably received within said guide opening and a lower end portion; and roller guide means for guiding said lower end portion for movement vertically along said tracks, said roller guide means including first and second pairs of guide rollers, and adjustment plate and mounting means for mounting said adjustment plate on said lower end portion, said first pair of guide rollers being arranged to engage one of said tracks at points spaced lengthwise thereof and being supported by said lower end portion for rotation about a first pair of axes positionally fixed relative to said movable part, said second pair of guide rollers being arranged to engage the other of said tracks at points spaced lengthwise thereof and being supported by said adjustment plate for rotation about a second pair of axes positionally fixed relative to said adjustment plate, and said mounting means mounts said adjustment plate on said lower end portion to adjust positioning of said second pair of axes relative to said first pair of axes transversely of the direction of said movement of said lower end portion, while maintaining said second pair of axes substantially parallel to said first pair of axes.

11. A support according to claim 10, wherein said mounting means includes a pin fixed to one of said lower end portion and said adjustment plate, a slot defined by the other of said lower end portion and said adjustment plate, said slot movably receiving said pin for movably coupling said adjustment plate to said lower end portion, a nut loosely carried by said adjustment plate, and a threaded fastener having a head portion rotatably engaging with said lower end portion and a threaded portion threadably engaging with said nut, and said threaded fastner upon rotation thereof effecting relative movement of said pin and slot for adjusting the position of said second pair of axes relative to said first pair of axes.

* * * * *